US007049747B1

(12) United States Patent
Goodberlet et al.

(10) Patent No.: US 7,049,747 B1
(45) Date of Patent: May 23, 2006

(54) FULLY-INTEGRATED IN-PLANE MICRO-PHOTOMULTIPLIER

(75) Inventors: James G. Goodberlet, Melrose, MA (US); Vemura H. S. Moorthy, Andhra Pradesh (IN)

(73) Assignee: Massachusetts Institute of Technology, Cambridge, MA (US)

( * ) Notice: Subject to any disclaimer, the term of this patent is extended or adjusted under 35 U.S.C. 154(b) by 270 days.

(21) Appl. No.: 10/606,870

(22) Filed: Jun. 26, 2003

(51) Int. Cl.
*H01J 43/04* (2006.01)

(52) U.S. Cl. ..... 313/532

(58) Field of Classification Search ..... 313/532–536, 313/103 R, 103 CM, 104, 105 R, 105 CM; 250/214 VT, 207
See application file for complete search history.

(56) References Cited

U.S. PATENT DOCUMENTS 3,735,184 A * 5/1973 Maeda ..... 313/105 R
4,095,132 A * 6/1978 Fraioli ..... 313/103 CM
4,164,681 A * 8/1979 Catanese ..... 313/400
5,264,693 A 11/1993 Shimabukuro et al.
5,329,110 A * 7/1994 Shimabukuro et al. ..... 250/207
5,568,013 A * 10/1996 Then et al. ..... 313/532
6,384,519 B1 * 5/2002 Beetz et al. ..... 313/103 CM

OTHER PUBLICATIONS

"Silicon-Micromachined microchannel plates," Beetz et al. *Nuclear Instruments and Methods in Physics Research A 442*. 2000. p. 443-451, no month.

* cited by examiner

*Primary Examiner*—Joseph Williams
*Assistant Examiner*—Dalei Dong
(74) *Attorney, Agent, or Firm*—Gauthier & Connors LLP

(57) ABSTRACT

An integrated micro-photomultiplier is disclosed which employs sub-micron-wide channels for electron amplification. These channels are created with standard lithographic and planar-fabrication techniques, and sealed with a vacuum-deposition process. A photocathode, continuous dynode, anode and signal-collector are fabricated along the channels. This photomultiplier design obviates the needs for through-substrate etching, and mechanical assembly of separate layers. Because large-scale-integration techniques can be used to fabricate multiple micro-photomultipliers, significant reductions in device cost and size are expected. The integrated micro-photomultiplier is useful for high-speed, low-light-level optical detection, and may find applications in optical communications, visible or infrared imaging, and chemical or biological sensing.

6 Claims, 4 Drawing Sheets

FULLY-INTEGRATED IN-PLANE MICRO-PHOTOMULTIPLIER

This invention was made with government sponsorship under Contract No. N66001-00-1-8932 awarded by the U.S. Navy. The government has certain rights in the invention.

BACKGROUND OF THE INVENTION

Conventional photomultipliers (PMTs) are large (>1 $cm^3$), stand-alone devices that exhibit high gain for low-light-level detection. The best PMTs can detect a single photon, and some PMTs have response times of 1 nanosecond or less. The costs of conventional PMTs have fallen to about $500 per device. To date, PMTs have not been integrated onto chips, even though at least two designs have been proposed (see U.S. Pat. No. 5,568,013 and U.S. Pat. No. 5,264,693). The size and cost of traditional PMT's precludes their use in such applications as imaging and optical communications.

Ultrasensitive optical detection is desirable for optical sensors, spectral analysis, imaging, optical receivers and fluorescent microscopy. For example, some recent efforts to develop DNA-sequencing chips utilize fluorescent, site-specific molecular tags attached to the DNA backbone. Optical excitation of the DNA molecule with tags gives characteristic fluorescence that helps describe the structure of the DNA molecule. Since the fluorescence comes from single molecular tags, the light level is low and sensitive detectors are needed. Fluorescent tagging is used in a variety of biological assays to determine the presence of certain species. In spectroscopic applications, PMTs are used to detect faint spectral lines emitted from excited molecules or atoms. PMTs are also used in scintillation studies.

Two designs of integrated photomultipliers have been disclosed previously in patents. One design, proposed in U.S. Pat. No. 5,264,693, is depicted in FIG. 1. For this design, a photocathode 130 and dynodes 140 are enclosed in a large wet-etched chamber 120 fabricated on a planar substrate 160.

The device functions in the following manner. An incident photon passes through the transparent chamber cover 110 and strikes the photocathode 130. The interaction of the photon with the photocathode results in the emission of an electron into the vacuum chamber 120. An applied voltage accelerates the electron to collide with the first dynode. This collision results in the emission of several electrons, providing electron amplification. The amplification is repeated from dynode to dynode and the signal is measured as electron current at the final anode 150.

Unfortunately, the chamber 120 must be under high vacuum, and therefore the covering layer 110 may collapse on the dynodes and cathode unless it is made sufficiently thick. Increasing the cover thickness will be timely and costly. The photocathode 130 and dynodes 140 are patterned before the wet-etching step that defines the photomultiplier chamber. This can be a fatal flaw for such a device, since wet etching will ruin most photocathode materials. The high-efficiency photocathodes must be handled in a pure, high-vacuum environment.

A second design was proposed in U.S. Pat. No. 5,568,013, and is depicted in FIG. 2. This proposed design calls for wide (4 microns wide or greater) channels 220, and requires bonding of top 210 and bottom 270 covers as indicated in the diagram. The photocathode 230 can be patterned on the underside of the top cover, and the anode 250 may be patterned on the top side of the bottom cover. The long channels 220 act as a continuous dynode providing electron amplification as the electrons collide with the channel walls while traveling from cathode to anode.

The bonding step, required to fasten top and bottom covers, is time consuming and requires careful alignment of the covers to the channels. Additionally, since the photocathode has been patterned on the top cover, the bonding and alignment must be done in a high-vacuum environment to avoid ruining the cathode material. The bonding step requires high temperatures, which may also degrade device performance. The bonding procedure is also susceptible to vacuum leaks, should a small particle exist between the cover and substrate. Additionally, this design requires that a hole be fabricated through the substrate above the anode. Such deep etching can be costly and time consuming.

A third photomultiplier design has been proposed in the literature (Charles P. Beetz, et al, *Nucl. Instr. Meth. Phys. Res. A*, vol. 442 (2000) 443), and has been fabricated. In this design, depicted in FIG. 3, multiple parallel holes 320 are etched through a thin membrane of silicon 360. The walls of the long tubular holes are coated with appropriate material via chemical vapor deposition (CVD) to produce multiple parallel continuous dynodes for electron amplification. The resulting structure functions as a microchannel plate detector.

In Beetz et al. the CVD step restricts the type of materials that may be deposited on the tube walls. Also, only straight long holes are permitted for this device due to the fabrication technique. In some applications, curved channels would improve device performance. Again the etching of long narrow holes through the substrate can be time intensive and costly. Most importantly, for completion this device requires the assembly of separate physical elements, i.e. top cover 310 with cathode 330, electron-amplifying plate 360, and bottom cover 370 with anode or read-out array 350. This assembly must be done in a manner that preserves high vacuum inside the holes. The patent does not describe a method for vacuum-sealing the device, and tests of the submicrochannel plate were done in a vacuum environment.

SUMMARY OF THE INVENTION

This invention is comprised of a novel design for a fully-integrated micro-photomultiplier and a method for fabricating said device. An all-planar, sub-millimeter-size photomultiplier is proposed which utilizes sub-micron-wide channels for electron amplification. The photocathode, anode, signal collector and electron-amplifying regions are created with standard lithography and microfabrication techniques. The photocathode deposition and vacuum sealing of the device can be accomplished in a final vacuum-deposition step. This invention stems from the discovery that vacuum-deposition sealing of sub-micron-wide channels combined with a novel photomultipier design enable large-scale-integration and simplified device fabrication. This permits the mass production of low-cost, sub-1-mm-size, high-performance photomultipliers, which are suitable for a variety of applications in sensing, imaging and communications.

DETAILED DESCRIPTION OF THE INVENTION

Figure 1:
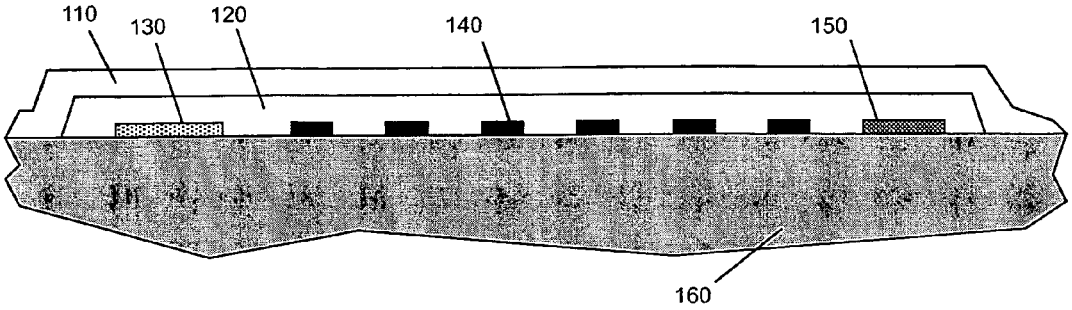
Figure 1 (Prior Art)
FIG. 1 is a cut-away side view of a previously proposed integrated photomultipier.
Figure 2:
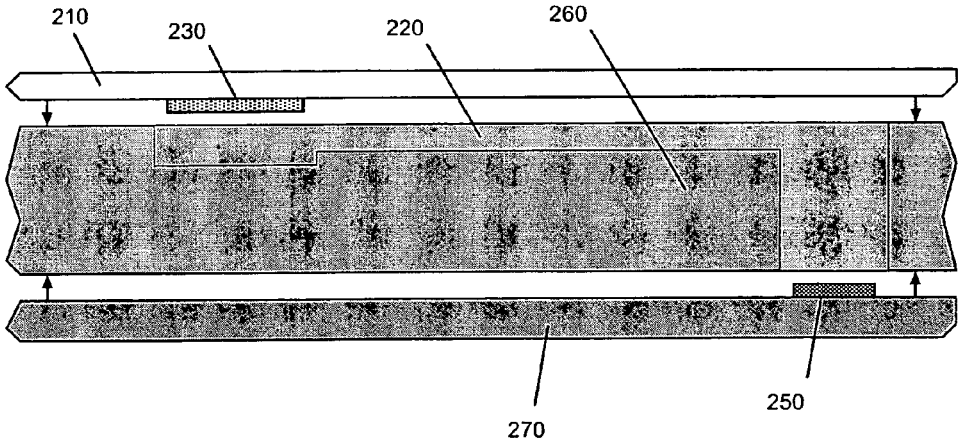
Figure 2 (Prior Art)
FIG. 2 is a cut-away side view of a previously proposed compact photomultiplier.
Figure 3:
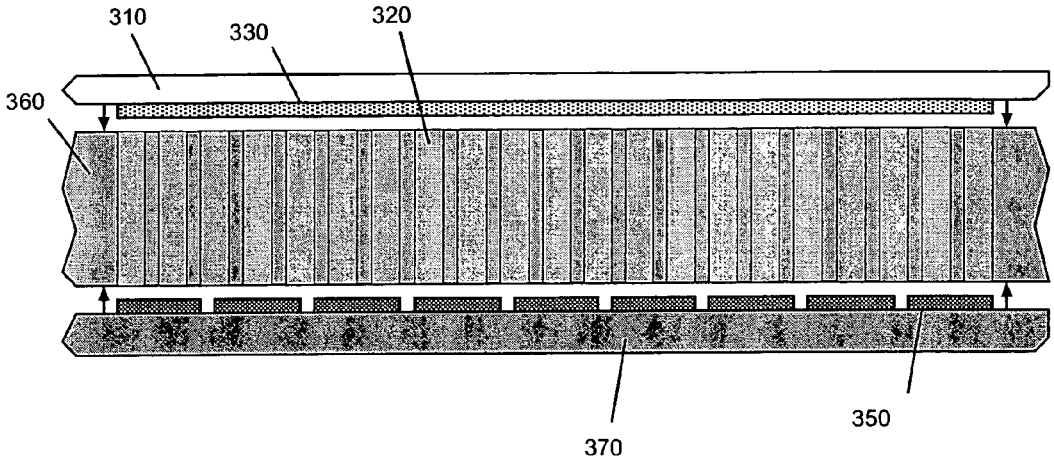
Figure 3 (Prior Art)
FIG. 3 is a cut-away side view of a demonstrated compact photomultiplier.
Figure 4A:
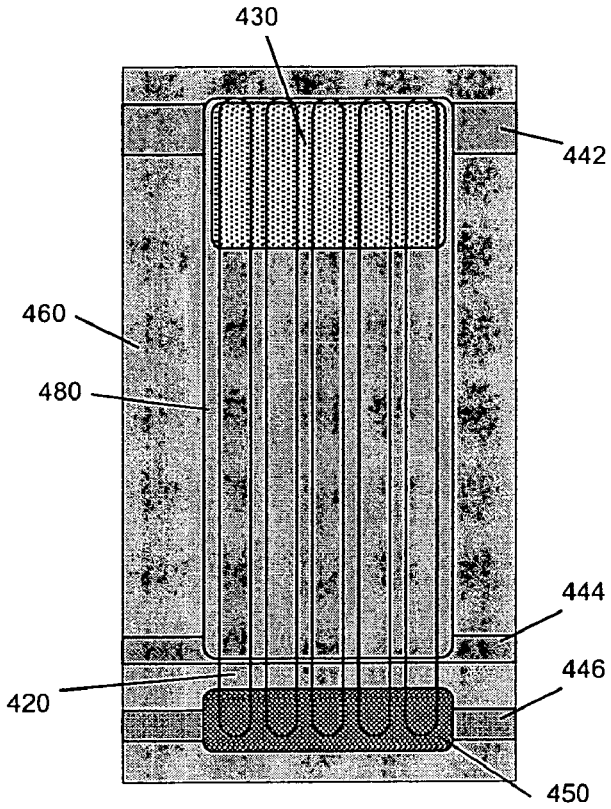
FIGS. 4*a*–4*c* are a top view, a cut-away end view and a cut-away side view, respectively, of the fully-integrated micro-photomultiplier of the invention.
Figure 4B:
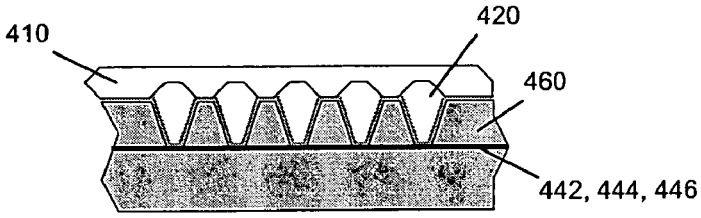
Figure 4C:
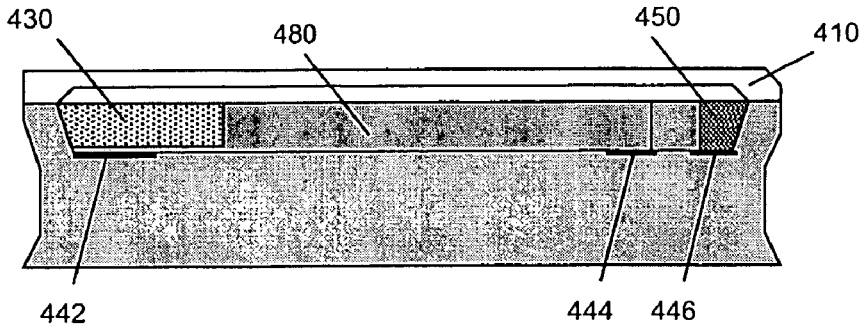

A planar, fully-integrated micro-photomuliplier device 400 of the invention is shown in FIGS. 4*a*–4*c*. FIG. 4*a* is a top view of the device showing the nanochannels 420, photocathode 430, resistive strip material 480, and buried electrical leads 442, 444 and 446. One electrical lead 442 provides a bias for the photocathode with respect to a second lead 444, which serves as the anode. The final lead 446 makes electrical contact with the signal collector 450, and provides a signal output from the device. For this device the width of the nanochannels is less than 1 micron, and their depth is at least 100 nm. In an exemplary embodiment, their width and depth are each about 200 nm, and the length is typically more than 50 times the width of the nanochannels. Only five channels are shown in the drawing, but the actual device will have tens or hundreds of channels.

A cut-away end view of the device is shown in FIG. 4*b*, and a cut-away side view of the device is shown in FIG. 4*c*. The end view of FIG. 4*b* shows a vacuum seal 410 that has been deposited over the nanochannels, and also shows sloped sidewalls of the channels.

The fully-integrated micro-photomultiplier device 400 operates as follows. Photons pass through the transparent vacuum seal 410 and strike the photocathode 430. The interaction of the photons with the photocathode results in the emission of electrons into the nanochannels 420. An electrical bias between the cathode lead 442 and anode lead 444 accelerates the electrons down the nanochannels.

As the electrons travel down the nanochannels 420, they collide with the channel walls resulting in the emission of more electrons. This process constitutes electron amplification within the channels. As the electrons impinge upon the anode 444, some pass by it and strike the signal-collector 450 providing an electrical current that is transported along the signal-collecting lead 446. This current is detected with external electronics. The amount of current detected on the signal-collecting lead 446 corresponds to the gain of the dynode section, quantum efficiency of the photocathode, and flux of photons on the photocathode.

For the fully-integrated micro-photomultiplier of this invention, the section of the long channels, which is coated with the resistive strip, acts as continuous dynode, similar to the devices of U.S. Pat. No. 5,568,013, and Beetz, et al. (*Nucl. Instr. Meth. Phys. Res. A, vol.* 442 (2000) 443), both of which are incorporated herein by reference in their entireties. Electron amplification occurs within this region of the micro-photomultiplier. The design and operation of the continuous dynode section are detailed in the '013 patent and Beetz et al. and references therein.

One advantage of the fully-integrated micro-photomultiplier, as depicted in FIGS. 4*a*–4*c*, is that the channel length and geometry can be varied easily. This is possible because planar fabrication technology is used. Increasing the channel length, and providing curved or zigzag channel geometry, can substantially increase the signal output from the device and reduce ion-feedback noise. These improvements in device performance are well understood by those skilled in the art of photomultiplier technology. A second advantage of this design is that the nanochannel walls can be coated with any material that can be deposited by e-beam evaporation, sputtering or chemical vapor deposition. This greatly increases the number of materials that can be used to fabricate the integrated photomultiplier. Certain materials have high secondary-electron yield, which will improve electron amplification within the channels and increase signal output. A third advantage is the narrowness of the channels, which permit shorter channel length. This reduces the response time of the device to well below 1 nanosecond, which is desirable for most applications. Additionally, because of their compact size, the photomultipliers can be thermally cooled easily with integrated cooling chips to reduce their background noise level.

A novel fabrication method has been developed to enable planar fabrication and large-scale-integration of the micro-photomultiplier. In particular, two process steps play a critical role in fabricating the device: etching of channels with sloped sidewalls, and angle-oriented deposition of a vacuum seal via e-beam evaporation. Those skilled in the art of microfabrication will readily understand these two methods as well as the preferred fabrication process outlined below.

The preferred substrate 460 for the micro-photomultiplier is glass or quartz, although other insulating and etchable materials may be used. An oxide-coated wafer will also suffice. In the first level of lithography, the underlying electrical leads 442, 444 and 446 are patterned. The metallic leads can be deposited by a lift-off technique. After defining these conductive leads, the substrate is coated with a layer of oxide, which has a thickness equivalent to the desired channel depth. In the preferred embodiment, the thickness would be 200 nm to 800 nm. In the second level of lithography, the nanochannels are patterned and etched to the underlying electrical leads.

In an exemplary embodiment, low-cost patterning of 100 nm- to 500 nm-wide channels is done using conformable-contact photolithography (see J. G. Goodberlet, *Appl. Phys. Lett.*, vol. 76 (2000) p. 667, incorporated herein by reference).

The channels are etched in a reactive-ion etcher. By controlling the plasma-etching conditions, i.e. lowering the plasma bias, increasing the pressure, choosing an appropriate gas or gas mixture, and using a polymer etch mask with a low etch selectivity, sloped channel walls are formed. When an etch mask exhibits low etch selectivity, the mask itself will etch slowly while the substrate below is etching. During the etching step, the mask etches back exposing more area on the substrate to the etching plasma. This results in sloped sidewalls rather than vertical walls, as would be the case for a hard etch mask with high etch selectivity. The sloping of the nanochannels' side walls facilitates the coating in subsequent processing steps. Also during the etching step, it is necessary to etch deep enough to expose the underlying electrical leads 442, 444 and 446.

Figure 5:
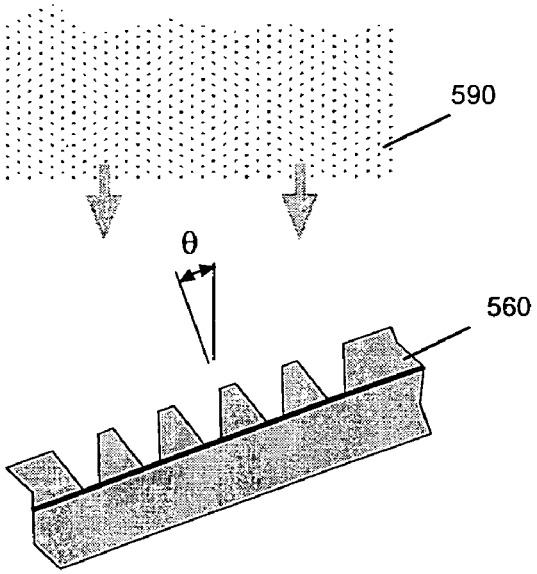
FIG. 5 is an angle-oriented material deposition step used to coat channel walls and to seal the nanometer-scale channels.

In the third level of lithography, the dynode section is created. The dynode section is patterned, and the resistive strip is deposited by e-beam evaporation followed by lift-off processing. The dynode section must make electrical contact at its ends with the underlying leads 442 and 446 during this step. In an exemplary embodiment, the material used for the resistive strip is amorphous silicon, and its thickness should be less than 50 nm. This material serves both as a resistive strip and as a secondary-electron emissive layer (see Beetz et al.). If the slope of the channel sidewalls is inadequate to assure their coating, then the substrate 560 may be tipped slightly by an angle θ to expose the sidewalls to the flux of particles 590 from the e-beam evaporation source, as indicated in FIG. 5. This will require tilting the substrate first in one direction and then in the opposite direction. For sidewall coating, the amount of tipping will range from 0 degrees to 30 degrees, depending on the slope of the side walls after etching. Vertical side walls will require a larger tipping angle.

In the fourth level of lithography, the signal collector is patterned. Conductive metal is deposited by electron-beam evaporation followed by lift-off processing. The purpose of this step is to coat the side and end walls of the channels at the collector for greater detection efficiency.

In the fifth level of lithography, the photocathode is deposited in a method similar to that used in the third level of lithography. In an exemplary embodiment, the photocathode is deposited via e-beam deposition under high vacuum through a stencil mask. The stencil mask has patterned holes in the shape of the photocathode, and is aligned to the substrate either inside or outside the vacuum chamber. The photocathode deposition must be done under high vacuum to preserve the quality of the photocathode material. After deposition, the stencil mask is removed from the substrate in vacuum, and the nanochannels are sealed. The sealing is also done via e-beam deposition, where the substrate is now tipped at large angles, θ, to prevent coating of most of the channel walls and channel bottom. For this step, the amount of tipping is greater than 45 degrees, and the preferred sealant material is an optically transparent glass, such as silicon dioxide or a glass composite. Some glass composites, such as Corning glass No. 1720 (see C. F. Miller and R. W. Shepard, *Vacuum* Vol. 11 (1961) p. 58, incorporated herein by reference), with very low permeability are well suited as a channel sealant material.

To adequately seal the channels, the substrate tipping and e-beam deposition should be repeated several times. Depositions should be carried out as the substrate is tipped steeply by an angle θ in one direction, much more than depicted in FIG. 5, and then tipped steeply in the opposite direction. By repeating this process several times, a bridge of sealant material forms over the channels, as depicted in FIG. 4*b*, item 410. The bridge of material over the channels closes when the thickness, t, of the deposited material satisfies $$t \; w/\sin\theta \qquad (1)$$

where w is the nanochannel's width and θ the tipping angle during e-beam deposition. Once the bridge is formed, material deposition can be carried out at normal incidence. This channel-sealing process has been carried out in our laboratory. The thickness of the sealant material above the channels should be at least one micron to reduce permeation of helium through the cover material and into the channels.

To improve the vacuum within the nanochannels, titanium getters may be added to the device above the photocathode region. However, many photocathodes act as vacuum getters themselves and the addition of titanium getters would then be unnecessary. The method of adding getters to vacuum-electronic devices is well know to those skilled in the art of vacuum electronics.

In an alternative method of depositing the photocathode, the photocathode material could be evaporated inside the device after channel sealing. This may be done by driving a large current through the photocathode's electrical lead, item 442 in FIG. 4*a*. The high current would locally heat the cathode material, causing its evaporation and redeposition inside the device. This would expose fresh cathode material inside the nanochannels, likely improving photocathode performance.

Although the fabrication of one device has been described, simultaneous fabrication of multiple devices on the same substrate in one- and two-dimensional arrays could be carried out readily. The arrays of closely spaced photomultipliers would be useful as low-light-level line scanners, spectral analyzers or imaging devices.

Although the present invention has been shown and described with respect to several preferred embodiments thereof, various changes, omissions and additions to the form and detail thereof, may be made therein, without departing from the spirit and scope of the invention.

What is claimed is:

1. A fully-integrated photomultiplier incorporated onto a single substrate comprising:

a plurality of parallel narrow channels, wherein the width of each channel is less than one micron;

a photocathode incorporated within said narrow channels and located at one end of said channels;

an electron-amplifying region, incorporated along the middle region of said narrow channels;

an anode incorporated at the end of said electron-amplifying region opposite said photocathode;

a signal collector incorporated within said channels near said anode;

isolated electrical leads incorporated for the purpose of making electrical contact to said photocathode, said electron-amplifying region, said anode and said signal collector; and an optically transparent covering material incorporated over said narrow channels providing a seal to maintain vacuum within said narrow channels.

2. The photomultiplier of claim 1, wherein said sub-micron-wide channels have straight, zig-zag, or curved geometry.

3. The photomultiplier of claim 1, wherein said covering material is a vacuum-deposited material.

4. The photomultiplier of claim 1, wherein electrical leads are incorporated at the base of said narrow channels, running transverse to said channels through said channel walls.

5. A one-dimensional array of photomultipliers incorporated onto a single substrate, wherein each photomultiplier comprises:

a plurality of parallel narrow channels, wherein the width of each channel is less than one micron;

a photocathode incorporated within said narrow channels and located at one end of said channels, an electron-amplifying region, incorporated along the middle region of said narrow channels, an anode incorporated at the end of said electron-amplifying region opposite said photocathode, a signal collector incorporated within said channels near said anode, isolated electrical leads incorporated for the purpose of making electrical contact to said photocathode, said electron-amplifying region, said anode and said signal collector, and an optically transparent covering material incorporated over said narrow channels providing a seal to maintain vacuum within said narrow channels, and wherein a signal is provided from each photomultiplier.

6. A two-dimensional array of photomultipliers incorporated onto a single substrate, wherein each photomultiplier comprises:

a plurality of parallel narrow channels, wherein the width of each channel is less than one micron, a photocathode incorporated within said narrow channels and located at one end of said channels, an electron-amplifying region, incorporated along the middle region of said narrow channels, an anode incorporated at the end of said electron-amplifying region opposite said photocathode, a signal collector incorporated within said channels near said anode, isolated electrical leads incorporated for the purpose of making electrical contact to said photocathode, said electron-amplifying region, said anode and said signal collector, and an optically transparent covering material incorporated over said narrow channels providing a seal to maintain vacuum within said narrow channels, and wherein a signal is provided from each photomultiplier.

* * * * *